US011267613B2

(12) United States Patent
Jiang et al.

(10) Patent No.: US 11,267,613 B2
(45) Date of Patent: Mar. 8, 2022

(54) ORIGAMI-BASED COLLAPSIBLE AND WATERTIGHT CASES

(71) Applicants: Hanqing Jiang, Chandler, AZ (US); Zirui Zhai, Tempe, AZ (US)

(72) Inventors: Hanqing Jiang, Chandler, AZ (US); Zirui Zhai, Tempe, AZ (US)

(73) Assignee: ARIZONA BOARD OF REGENTS ON BEHALF OF ARIZONA STATE UNIVERSITY, Scottsdale, AZ (US)

( * ) Notice: Subject to any disclaimer, the term of this patent is extended or adjusted under 35 U.S.C. 154(b) by 0 days.

(21) Appl. No.: 16/967,094

(22) PCT Filed: Jan. 31, 2019

(86) PCT No.: PCT/US2019/016040

§ 371 (c)(1),
(2) Date: Aug. 3, 2020

(87) PCT Pub. No.: WO2019/152643

PCT Pub. Date: Aug. 8, 2019

(65) Prior Publication Data

US 2021/0039832 A1 Feb. 11, 2021

Related U.S. Application Data

(60) Provisional application No. 62/764,832, filed on Aug. 16, 2018, provisional application No. 62/625,774, filed on Feb. 2, 2018.

(51) Int. Cl.
*B65D 19/02* (2006.01)
*B65D 21/08* (2006.01)
(Continued)

(52) U.S. Cl.
CPC ..... *B65D 21/086* (2013.01); *B65D 25/2802* (2013.01); *B65D 43/0202* (2013.01)

(58) Field of Classification Search
CPC ..... H01M 10/04; H01M 10/0583; H01M 10/0585; A45C 11/20; B65D 81/3813;
(Continued)

(56) References Cited

U.S. PATENT DOCUMENTS 2,525,838 A 10/1950 Smith et al.
4,793,507 A 12/1988 Delplanque
(Continued)

FOREIGN PATENT DOCUMENTS

CH 687317 A5 11/1996

OTHER PUBLICATIONS

International Search Report and Written Opinion for Application No. PCT/US2019/016040 dated May 14, 2019 (15 pages).
(Continued)

*Primary Examiner* — King M Chu
(74) *Attorney, Agent, or Firm* — Michael Best & Friedrich LLP

(57) ABSTRACT

A foldable, waterproof case includes a first wall and a second wall coupled to the first wall. The first and second walls at least partially define a cavity within the case. A lid is coupled to the second wall and is configured to selectively cover the cavity. A hinge is disposed between the first wall and the second wall. The first wall is rotatable relative to the second wall between a first, expanded position of the case and a second, collapsed position of the case. In the first position, the cavity includes a first volume and in the second position, the cavity includes a second volume that is less than the first volume. The hinge provides a waterproof connection between the first and second walls in the first position and in the second position.

20 Claims, 20 Drawing Sheets

(51) Int. Cl.
*B65D 25/28* (2006.01)
*B65D 43/02* (2006.01)

(58) Field of Classification Search
CPC ..... B65D 21/086; B65D 43/0202; B65D 25/2802; F25D 3/08; F25D 3/107; F25D 3/14
USPC ..... 220/6, 7
See application file for complete search history.

(56) References Cited

U.S. PATENT DOCUMENTS

| | | | | |
|---|---|---|---|---|
| 8,685,201 | B2 | 4/2014 | O'Rourke et al. | |
| 9,706,646 | B2 | 7/2017 | Jiang et al. | |
| 10,153,519 | B2 | 12/2018 | Jiang et al. | |
| 10,418,664 | B2 | 9/2019 | Jiang et al. | |
| 10,502,991 | B2 | 12/2019 | Yu et al. | |
| 10,660,200 | B2 | 5/2020 | Jiang et al. | |
| 2006/0144837 | A1* | 7/2006 | Linares | B29C 70/70 220/1.5 |
| 2006/0266778 | A1 | 11/2006 | Allotey | |
| 2007/0278913 | A1* | 12/2007 | Liu | B25H 3/028 312/220 |
| 2008/0302789 | A1 | 12/2008 | Stevenson | |
| 2009/0261111 | A1 | 10/2009 | Hsu | |
| 2010/0264180 | A1* | 10/2010 | Allotey | B60R 11/06 224/404 |
| 2013/0115512 | A1 | 5/2013 | Jiang et al. | |
| 2017/0338453 | A1 | 11/2017 | Yu et al. | |
| 2018/0002550 | A1 | 1/2018 | Cohen et al. | |
| 2021/0050601 | A1 | 2/2021 | Jiang et al. | |

OTHER PUBLICATIONS

International Report on Patentability for Application No. PCT/US2019/016040 dated Aug. 13, 2020 (8 pages).

* cited by examiner

ORIGAMI-BASED COLLAPSIBLE AND WATERTIGHT CASES

CROSS-REFERENCE TO RELATED APPLICATIONS

This application claims the benefit of U.S. Provisional Patent Application Nos. 62/625,774, filed Feb. 2, 2018, and 62/764,832, filed Aug. 16, 2018. The entire contents of these applications are incorporated by reference herein.

BACKGROUND

Cases for storing materials are often collapsible to be efficiently stored when not in use. However, known collapsible containers are not watertight.

SUMMARY

This disclosure relates generally to containers, and more specifically to collapsible and watertight cases.

In certain embodiments, a foldable, waterproof case includes a first wall and a second wall coupled to the first wall. The first and second walls at least partially define a cavity within the case. A lid is coupled to the second wall and is configured to selectively cover the cavity. A hinge is disposed between the first wall and the second wall. The first wall is rotatable relative to the second wall between a first, expanded position of the case and a second, collapsed position of the case. In the first position, the cavity includes a first volume and in the second position, the cavity includes a second volume that is less than the first volume. The hinge provides a waterproof connection between the first and second walls in the first position and in the second position.

In certain embodiments, a foldable case includes a water impermeable base, a first, water-impermeable side coupled to the base about a first hinge, and a second, water-impermeable side coupled to the base about a second hinge. The second side is positioned opposite the first side. A first, water-impermeable end and a second, water-impermeable end are also coupled to the base. The first end is coupled between the first side about a third hinge and the second side about a fourth hinge. The second end is coupled between the first side about a fifth hinge and the second side about a sixth hinge. The second end is positioned opposite the first end. A water-impermeable lid is coupled to the first end and is positioned opposite the base. The lid selectively encloses a cavity defined by the base, the first and second sides, and the first and second ends. The first and second sides, the first and second ends, and the base are moveable between a first expanded position of the case, and a second collapsed position of the case. The case further includes at least one latch configured to mechanically secure the lid to the first end.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
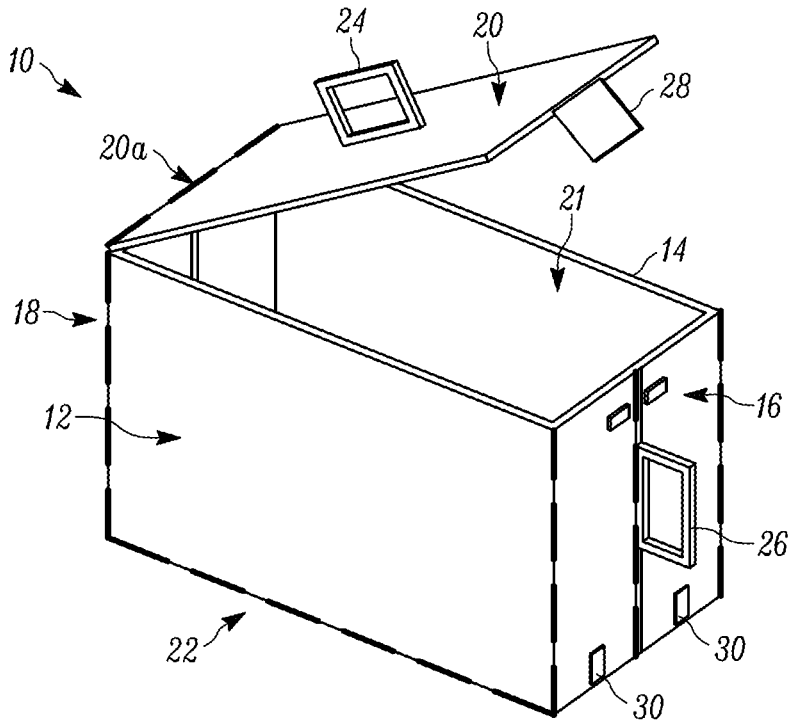
FIG. 1 is a perspective view of an origami-based collapsible and watertight case in accordance with an embodiment.
Figure 2:
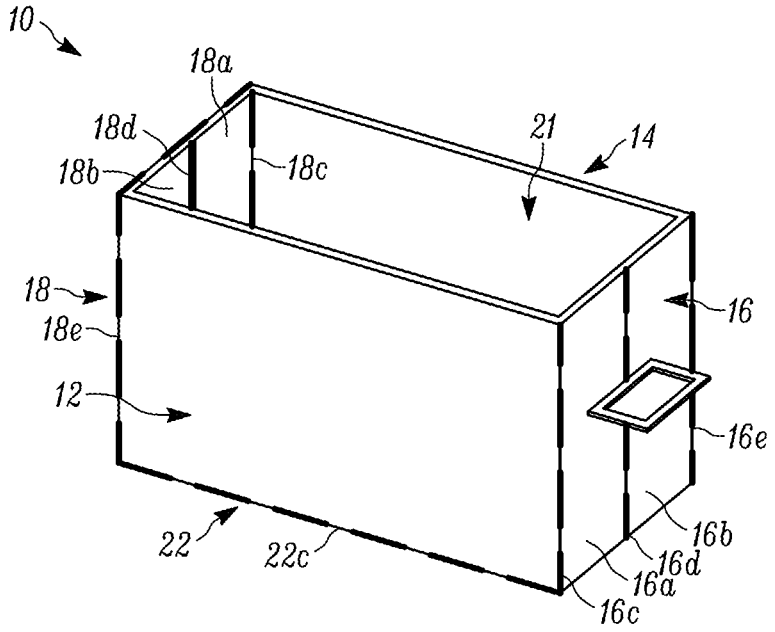
FIG. 2 is a perspective view of the case of FIG. 1 in an expanded orientation with portions removed.
Figure 3:
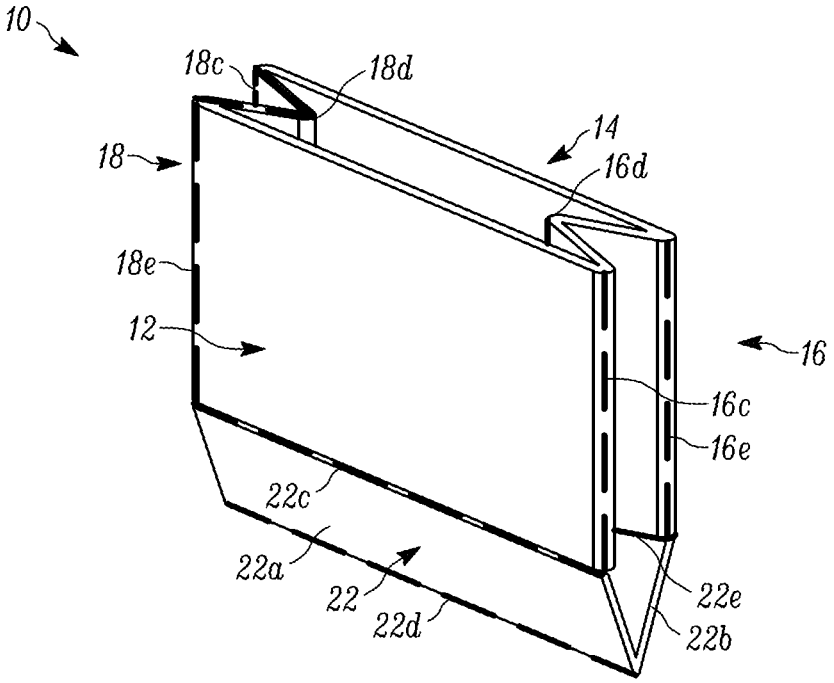
FIG. 3 is a perspective view of the case of FIG. 1 in a collapsed orientation with portions removed.

FIGS. 1-9B illustrate an origami-based collapsible and watertight case 10. The case 10 may be used for a variety of purposes. The case 10 is repositionable between an expanded orientation, as shown in FIGS. 1 and 2, and a collapsed orientation, as shown in FIG. 3. The case 10 includes first and second sides (side walls) 12 and 14, first and second ends (end walls) 16 and 18, a removable lid 20, and a base or bottom 22, which together define a cavity 21 (FIG. 2) having a cavity volume. The lid 20 is pivotable about a watertight pin joint 20*a* (FIG. 4A) between an open position as illustrated FIG. 1, and a closed position to selectively cover the cavity 21. A top latch 28 (FIG. 8B) is provided on the lid 20 proximate the first end 16 and is configured to removably secure the lid 20 in the closed position. The lid 20 also includes a first handle 24 graspable to carry the case 10. Similarly, the first end 16 includes a second handle 26 graspable by a user to carry the case 10. Bottom latches 30 (FIG. 9A) are provided on the first end 16 and located proximate the bottom 22.

With reference to FIG. 2, the first and second sides 12 and 14, the first and second ends 16 and 18, and the bottom 22 are removably coupled together at foldable and watertight pin joints 16*c* and 16*e*, 18*c* and 18*e*, and 22*c* and 22*e* (identified by dashed lines). Specifically, the first end 16 couples to the first side 12 along pin joint 16*c*, and to the second side 14 along pin joint 16*e*. Likewise, the second end 18 couples to the first side 12 along the pin joint 18*e*, and to the second side 14 along pin joint 18*c*. Moreover, the bottom 22 couples to the first side 12 along pin joint 22*c*, and to the second side 14 along pin joint 22*e* (FIG. 3).

When oriented in the expanded position, the illustrated embodiment of the case 10 has a length of approximately 11 inches as measured between the first end 16 and the second end 18. The case 10 has a width of approximately 5.5 inches as measured between the first side 12 and the second side 14. The case 10 has a height of approximately 7 inches as measured between the bottom 22 and the lid 20. Other embodiments include various other values of lengths, widths, and heights than that illustrated.

The first end 16 further includes first and second panels 16*a* and 16*b* that are coupled together along a pin joint 16*d*. Similarly, the second end 18 incudes third and fourth panels 18*a* and 18*b* coupled together along a pin joint 18*d*. Likewise, the bottom 22 includes fifth and sixth panels 22*a* and 22*b* coupled together along a pin joint 22*d*. The pin joints provide water-proof connections between the first and second panels and the first and second ends. Some or all of the pin joints 16*d*, 18*b*, 22*d* may, for example, be a piano-style hinge, a single flexible piece/gasket, and/or other joint.

With reference to FIG. 3, the pin joints define hinges that permit the first and second sides 12 and 14, first and second ends 16 and 18, and bottom 22 to pivot with respect to one another as the case 10 is repositioned between the expanded orientation and the collapsed orientations. When not in use, the case 10 can be stored in a collapsed orientation to save storage space. The cavity 21 has a lesser volume in the collapsed position than in the expanded position. Specifically, as shown in FIG. 3, as the case 10 folds from the expanded orientation to the first collapsed orientation, the first end 16 folds inwardly as the first and second panels 16*a* and 16*b* pivot about the pin joints 16*c*, 16*d*, and 16*e*. Similarly, the second end 18 also folds inwardly relative to the expanded position as the third and fourth panels 18*a* and 18*b* pivot about the pin joints 18*c*, 18*d*, and 18*e*. Meanwhile, the bottom 22 folds outwardly relative to the expanded position as the fifth and sixth panels 22*a* and 22*b* pivot about the pin joints 22*c*, 22*d*, and 22*e*. In alternate embodiments, the first end 16 folds outwardly as the first and second panels 16*a* and 16*b* pivot about the pin joints 16*c*, 16*d*, and 16*e*. Similarly, the second end 18 also folds outwardly relative to the expanded position as the third and fourth panels 18*a* and 18*b* pivot about the pin joints 18*c*, 18*d*, and 18*e*. Meanwhile, and as illustrated in FIG. 3, the bottom 22 folds outwardly relative to the expanded position as the fifth and sixth panels 22*a* and 22*b* pivot about the pin joints 22*c*, 22*d*, and 22*e*.

Figure 4A:
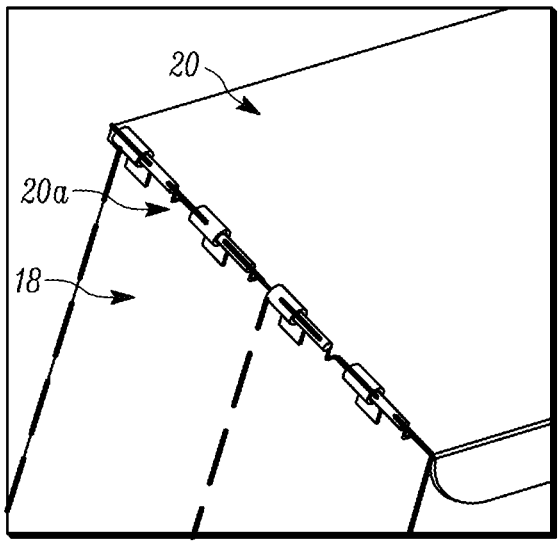
FIG. 4A is a perspective detail view of the case of FIG. 1, illustrating a lid coupled to a side via a first watertight pin joint.
Figure 4B:
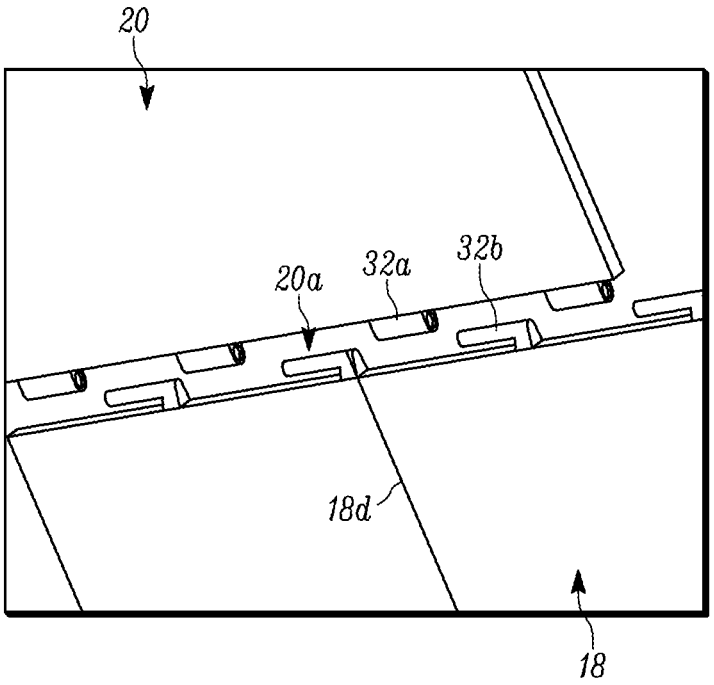
FIG. 4B is a perspective detail view of the case of FIG. 1, illustrating the lid removed from the side.
Figure 4C:
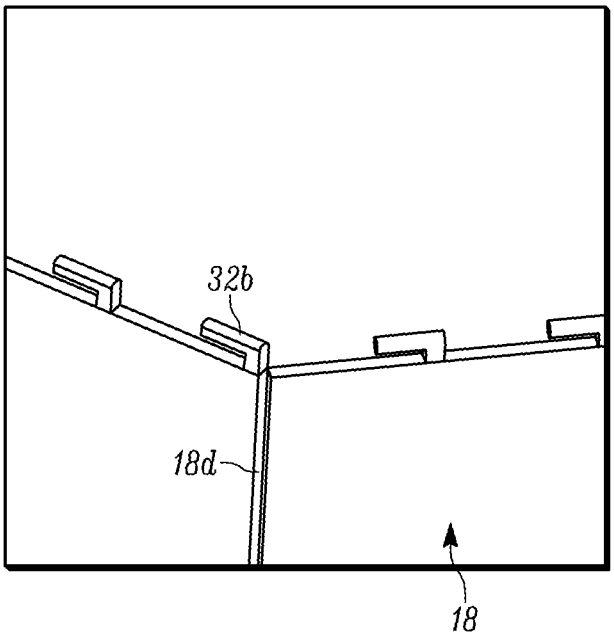
FIG. 4C is a perspective detail view of the case of FIG. 1, illustrating the side folding along a second watertight pin joint.

FIGS. 4A-4C illustrate removal of the lid 20 from the case 10 prior to repositioning the case 10 into the collapsed orientation. The lid 20 is depicted in FIG. 4A coupled to the second end 18 via the pin joint 20*a*. With reference to FIG. 4B, pin joint 20*a* includes pins 32*b* provided on the second end 18, and barrels 32*a* provided on the lid 20. The barrels 32*a* are configured to removably receive the pins 32*b* to couple the lid 20 to the second end 18. Together, the barrels 32*a* and pins 32*b* cooperate to form a watertight seal. In some embodiments, each of the pin joints of the case 10 include pins and barrels. With reference to FIG. 4C, after the lid 20 is removed, the second and third panels 18*a* and 18*b* can subsequently fold inwardly about pin joint 18*d* to reposition the case 10 in the collapsed orientation. In some embodiments, the bottom 22 may be a single, removable piece (i.e., the bottom may not include pin joint 22*d*). In this embodiment, the bottom 22 may be removed similar to the lid 20 prior to repositioning the case 10 into the collapsed position. Removing the bottom 22, as well as the lid 20, may reduce the overall height of the case 10 in the collapsed position.

Figure 5:
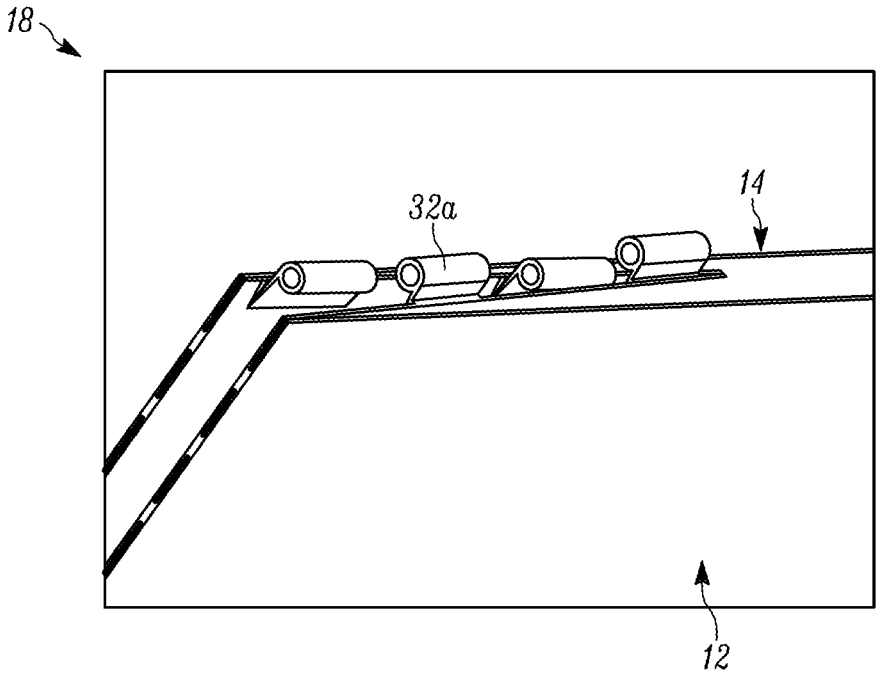
FIG. 5 is a perspective detail view of the case of FIG. 1 in the collapsed orientation.

With reference to FIG. 5, in some embodiments the barrels 32*a* are spaced apart from one another by a distance greater than a length of each respective barrel 32*a*, so that when the case 10 is in the collapsed orientation, the barrels 32*a* do not interfere with one another.

Figure 6:
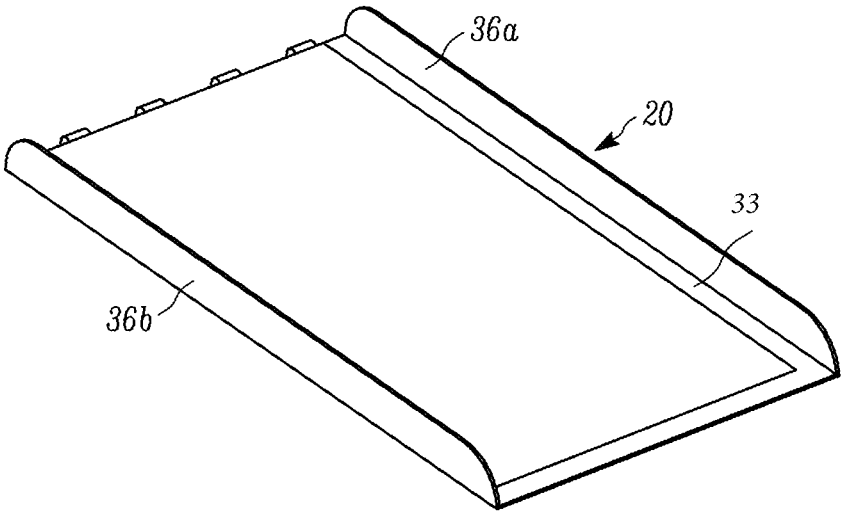
FIG. 6 is a perspective view of the lid of the case of FIG. 1.

With reference to FIG. 6, the lid 20 may further include a waterproof seal member 33 provided about the perimeter of an inner surface of the lid 20. The waterproof seal member 33 can be formed from any suitable waterproofing material (e.g., rubber) so as to prevent water from entering into the case while the lid 20 is in the closed position. The lid further includes first and second flanges 36*a* and 36*b* that can overlap the first and second sides 12 and 14, respectively, when the lid 20 is in the closed position.

Figure 7:
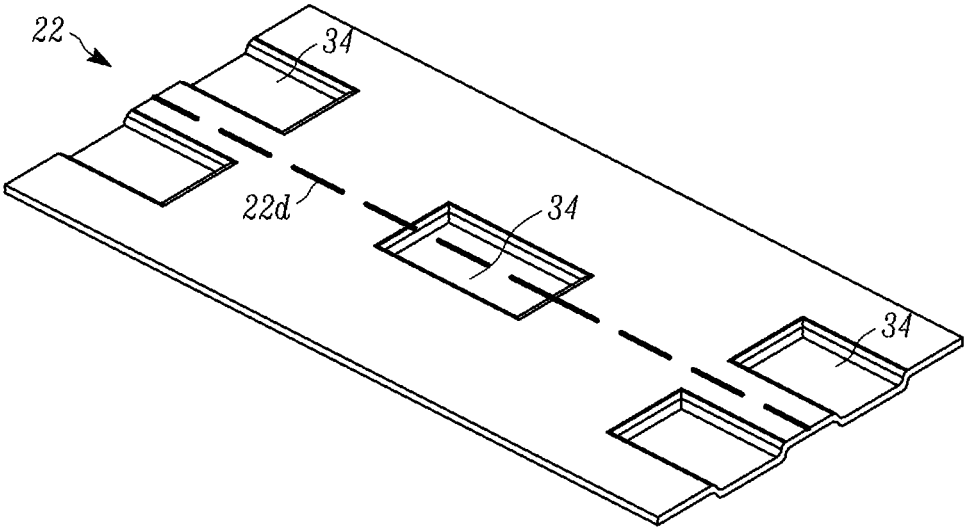
FIG. 7 is a perspective view of the base of the case of FIG. 1.

With reference to FIG. 7, the bottom 22 includes recessed surfaces 34 provided in a bottom surface of the bottom 22. The recessed surfaces 34 can correspond to features of the lid 20 (e.g., the first handle 24, the top latch 28, etc.), thereby permitting two cases 10 to be stably stacked one on top of the other without interfering with the aforementioned features.

Figure 8A:
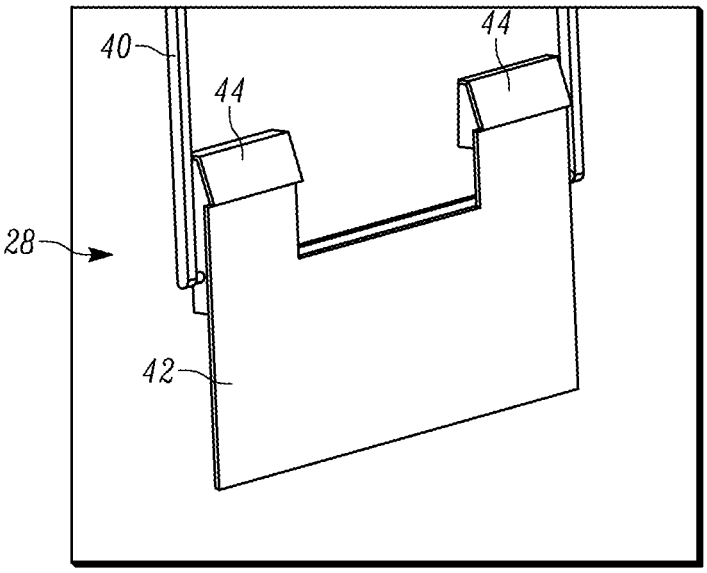
FIG. 8A is a perspective detail view of the case of FIG. 1, illustrating a top latch in a latched orientation.
Figure 8B:
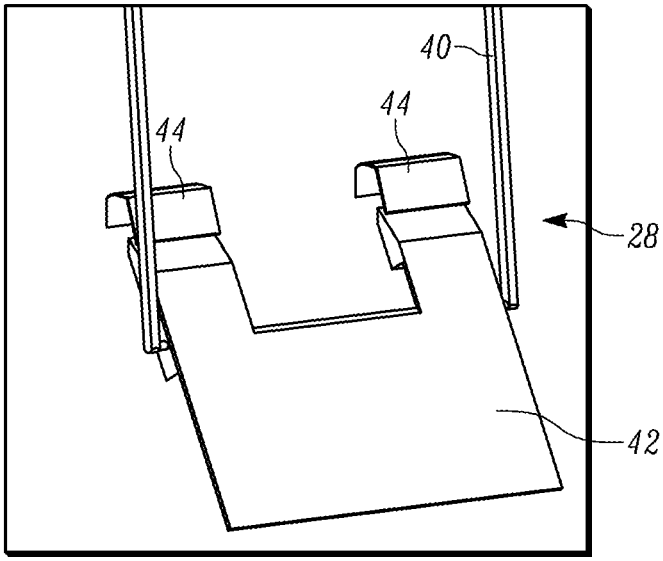
FIG. 8B is a perspective detail view of the case of FIG. 1, illustrating the top latch in an unlatched orientation.

With reference to FIGS. 8A and 8B, the top latch 28 is depicted in a latched orientation (FIG. 8*a*) and an unlatched orientation (FIG. 8B). The top latch 28 includes a first pivoting member 42 that engages a pair of first protrusions 44 to tension a first clip 40. The first clip 40 engages a second protrusion (not shown) provided on the adjacent face of the lid 20.

Figure 9A:
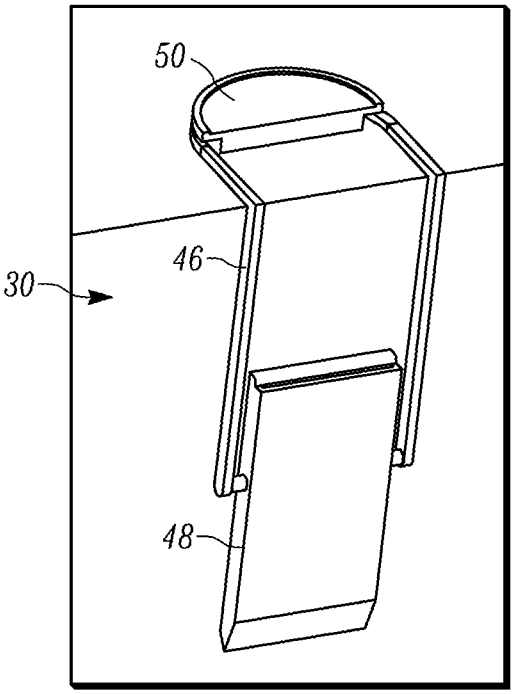
FIG. 9A is a perspective detail view of the case of FIG. 1, illustrating a bottom latch in a latched orientation.
Figure 9B:
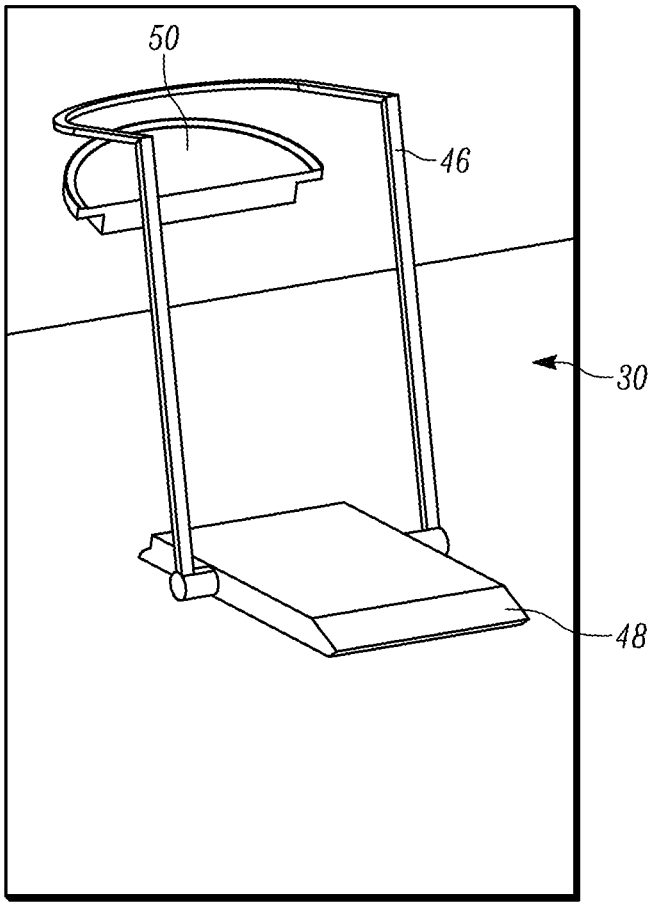
FIG. 9B is a perspective detail view of the case of FIG. 1, illustrating the bottom latch in an unlatched orientation.

With reference to FIGS. 9A and 9B, the bottom latch 30 is depicted in a latched orientation (FIG. 9A) and an unlatched orientation (FIG. 9B). The bottom latch 30 includes a pivoting member 48 rotatably pinned to a surface of the first end 16 and pivotable to tension a second clip 46. The second clip 46 engages a second protrusion 50 provided on the adjacent face of the bottom 22. In this way, the bottom latch 30 secures the first end 16 to the bottom 22 in the expanded orientation. The second side 18 can also include bottom latches 30 to secure the second side 18 to the bottom 22 in the expanded orientation.

The waterproof case 10 can be formed from any suitable material, such as metal (e.g., steel, aluminum, etc.), plastic, carbon fiber, and Kevlar, etc. Due to the construction of the case 10, in the expanded position and with the lid 20 closed, the case 10 is watertight (i.e., water cannot enter into an interior of the case 10), and the contents of the case 10 are kept dry.

FIGS. 10A-15C illustrate other embodiments of cases. At least some differences and similarities between the case 10 and the waterproof cases in FIGS. 10A-15C are described below. Similar features are identified with similar reference numbers, plus 100, 200, etc.

Figure 10A:
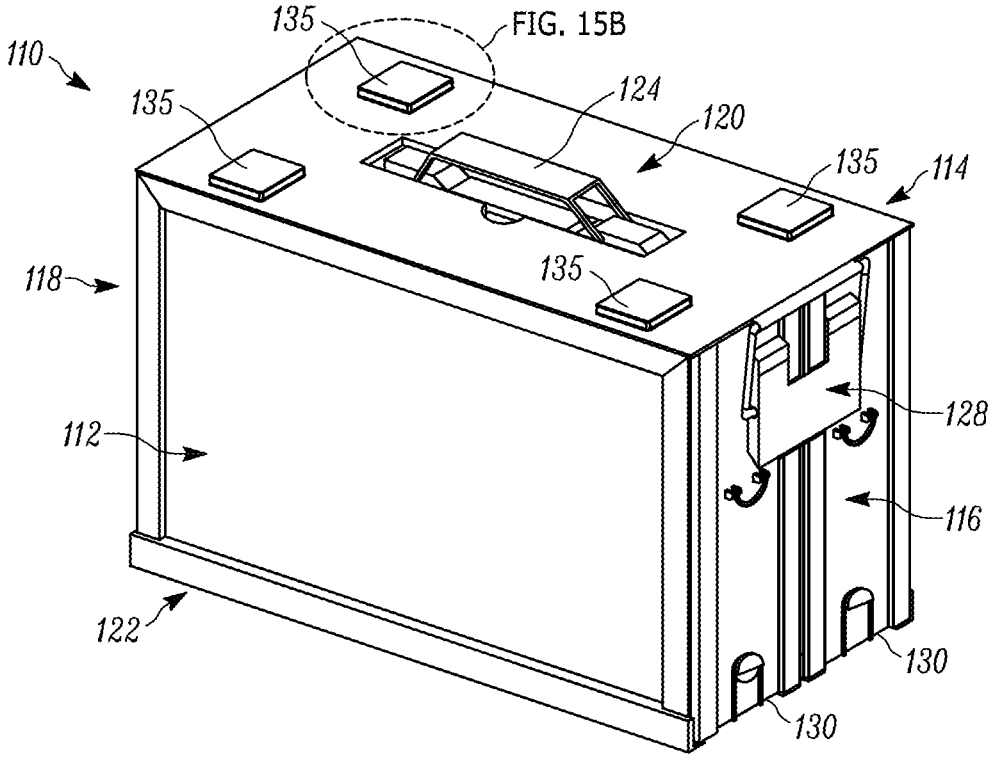
FIG. 10A illustrates a top perspective view of an origami-based collapsible and watertight case according to another embodiment.
Figure 10B:
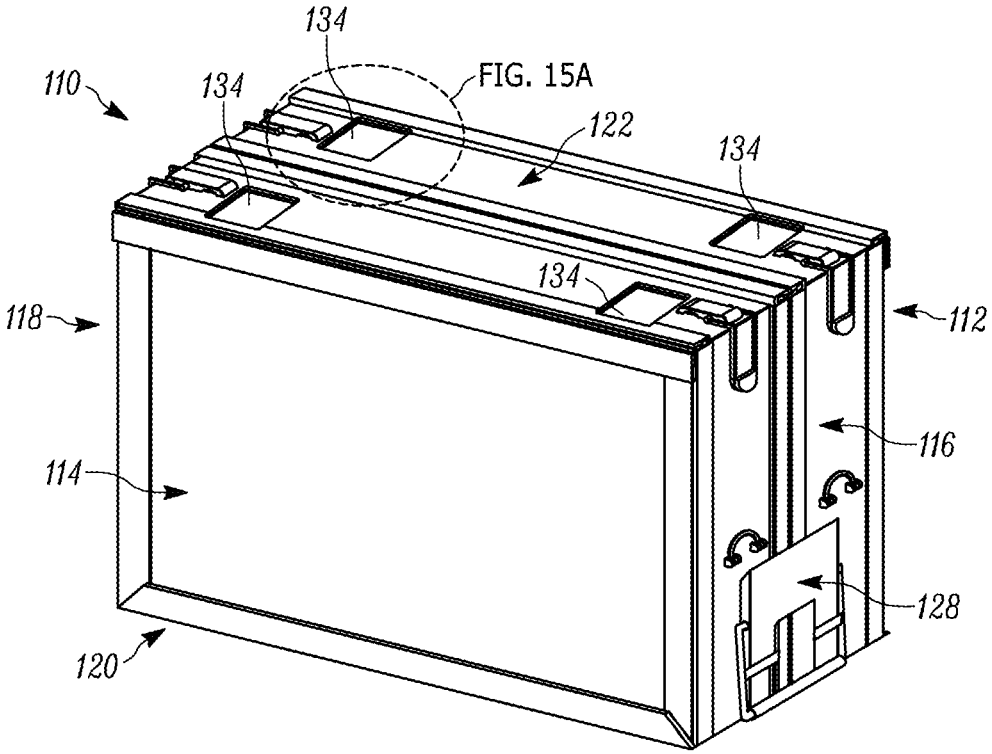
FIG. 10B illustrates a lower perspective view of the case shown in FIG. 10A.
Figure 10C:
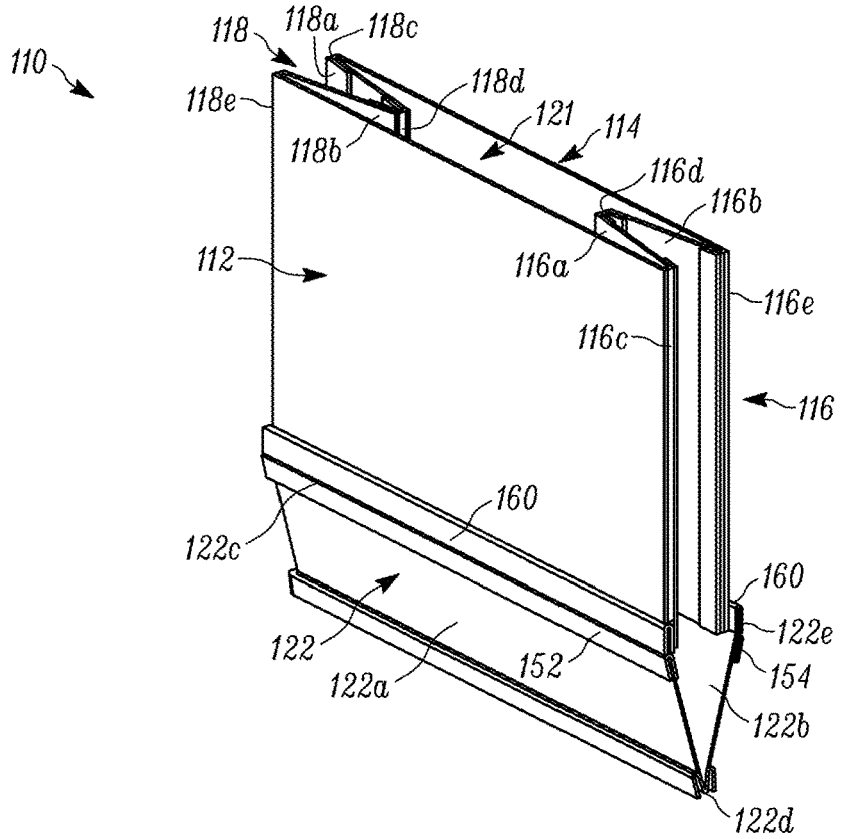
FIG. 10C illustrates a perspective view of the case of FIG. 10A in a collapsed orientation with portions removed.
Figure 10D:
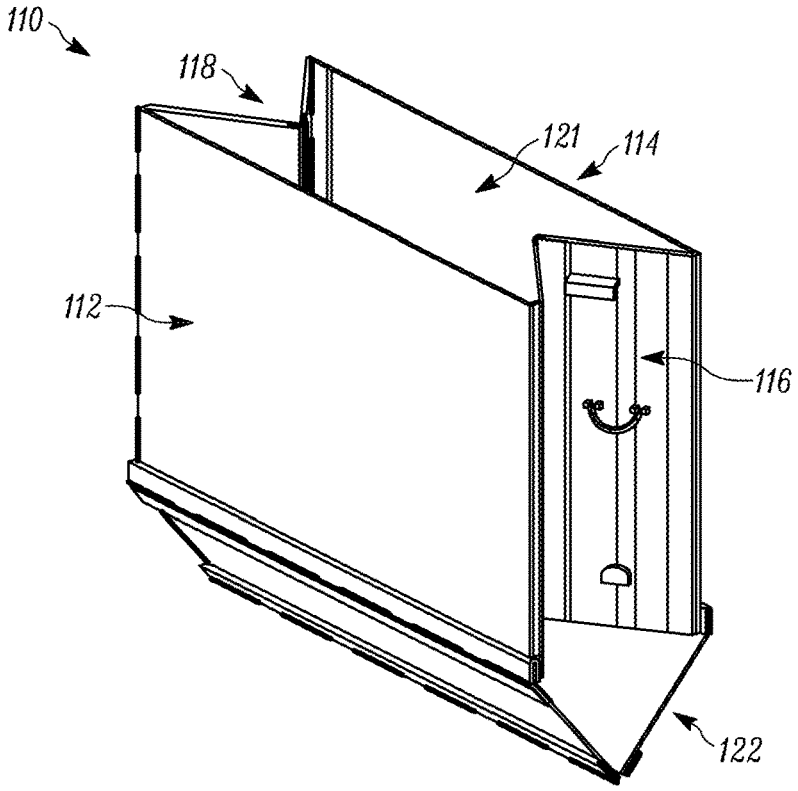
FIG. 10D illustrates a perspective view of the case of FIG. 10A in another collapsed orientation with portions removed.

With reference to FIGS. 10A-10D, a case 110 may be repositionable between an expanded orientation, as shown in FIGS. 10A and 10B, and a collapsed orientation, as shown in FIG. 10C. The case 110 includes first and second sides 112 and 114, first and second ends 116 and 118, a removable lid 120, and a base or bottom 122, which together define a cavity 121 having a cavity volume. The lid 120 may be pivotable about a watertight pin joint 120*a* between an open position as illustrated FIG. 11A, and a closed position as illustrated in FIG. 10A, which selectively covers the cavity 121. In the illustrated embodiment a top latch 128 is provided on the lid 120 proximate the first end 116 and configured to removably secure the lid 120 in the closed position. The lid 120 also includes a first handle 124 graspable to carry the case 110. Bottom latches 130 (FIGS. 13C and 13D) are provided on the first end 116 and the second end 118, and located proximate the bottom 122.

With reference to FIG. 10C, the first and second sides 112 and 114, the first and second ends 116 and 118, and the bottom 122 are removably coupled together at foldable and watertight joints 116*c* and 116*e*, 118*c* and 118*e*, and 122*c* and 122*e*. Specifically, the first end 116 couples to the first side 112 along the joint 116*c*, and to the second side 114 along the joint 116*e*. Likewise, the second end 118 couples to first side 112 along the joint 118*e*, and to the second side 114 along the joint 118*c*. Additionally, the bottom 122 couples to first side 112 along joint 122*c*, and to the second side 114 along joint 122*e*. The joints 116*c* and 116*e*, 118*c* and 118*e*, and 122*c* and 122*e* permit the first and second sides 112 and 114, the first and second ends 116 and 118, and the bottom 122 to pivot with respect to one another as the case 110 is repositioned between the expanded orientation and the collapsed orientation. The volume of the cavity 121 in the collapsed orientation is less than the volume of the cavity 121 in the expanded orientation. Depending on the stiffness of the joints, the case 110 may fold a different amount. For example, a case 110 with stiffer joints will fold less, and include a larger cavity volume in the collapsed position (see e.g., FIG. 10D).

Figure 10E:
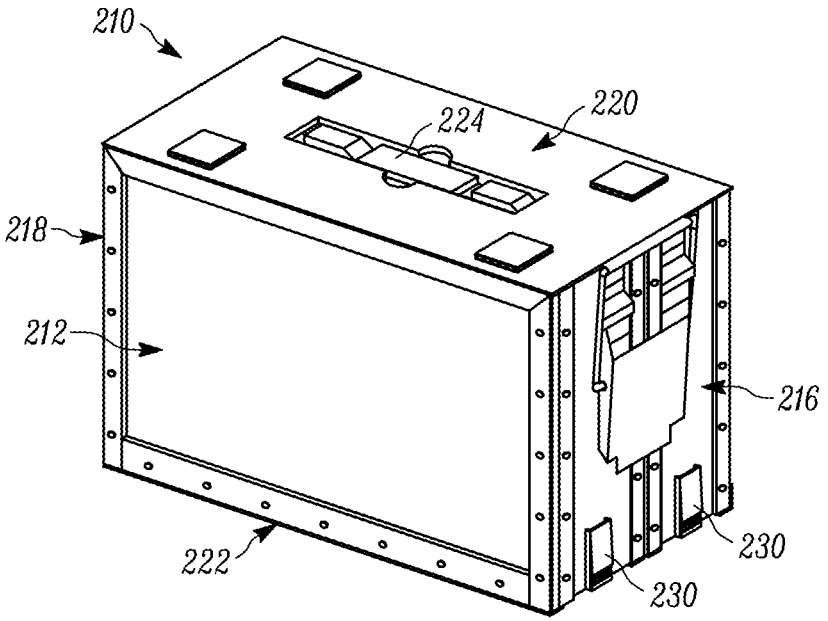
FIG. 10E is a perspective view of an origami-based collapsible and watertight case \according to another embodiment of the present invention.
Figure 10F:
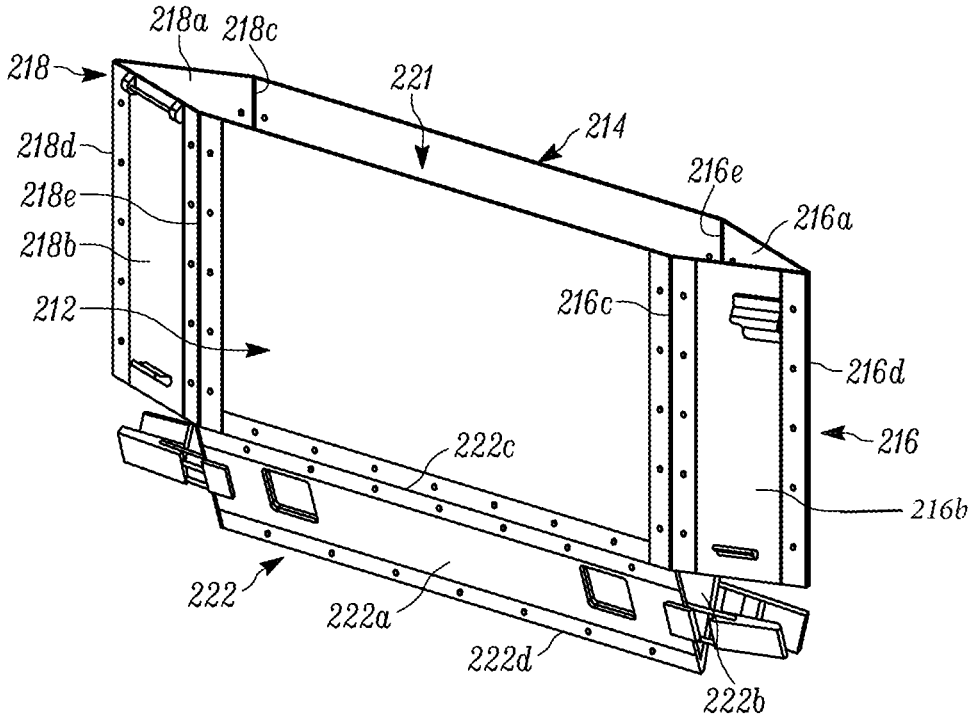
FIG. 10F illustrates a perspective view of the case of FIG. 10E in a collapsed orientation with portions removed.

With reference to FIGS. 10E and 10F, a case 210 may include a first end 216 that folds outwardly as first and second panels 216*a* and 216*b* pivot about pin joints 216*c*, 216*d*, and 216*e*. Similarly, a second end 218 also folds outwardly relative to the expanded position as third and fourth panels 218*a* and 218*b* pivot about pin joints 218*c*, 218*d*, and 218*e*. Meanwhile, a bottom 222 folds outwardly relative to the expanded position as fifth and sixth panels 222*a* and 222*b* pivot about the three pin joints (only two shown 222*c*, 222*d*). Folding the case 210 outwardly may further reduce the volume of the cavity 221 in the collapsed orientation as compared to the embodiment of FIGS. 10A-10D.

Figure 10G:
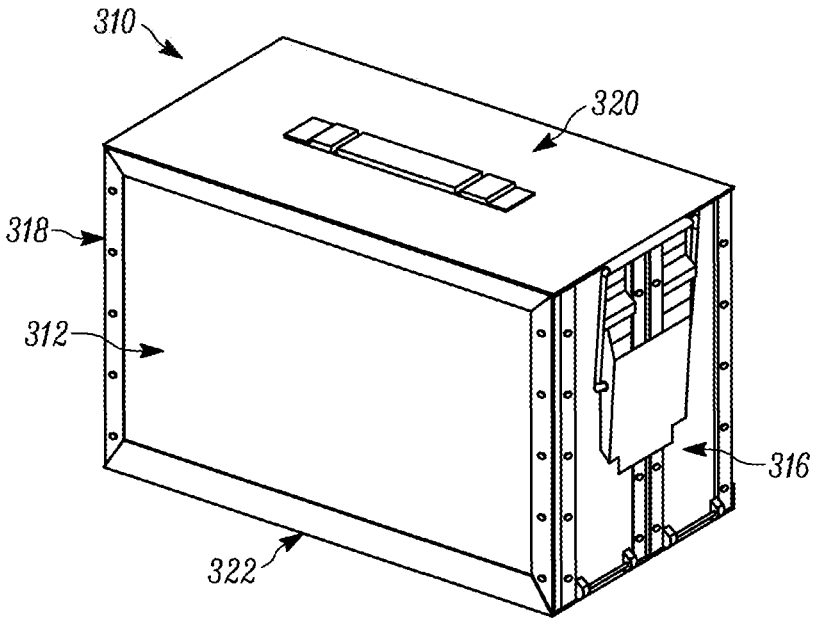
FIG. 10G is a perspective view of an origami-based collapsible and watertight case according to another embodiment.
Figure 10H:
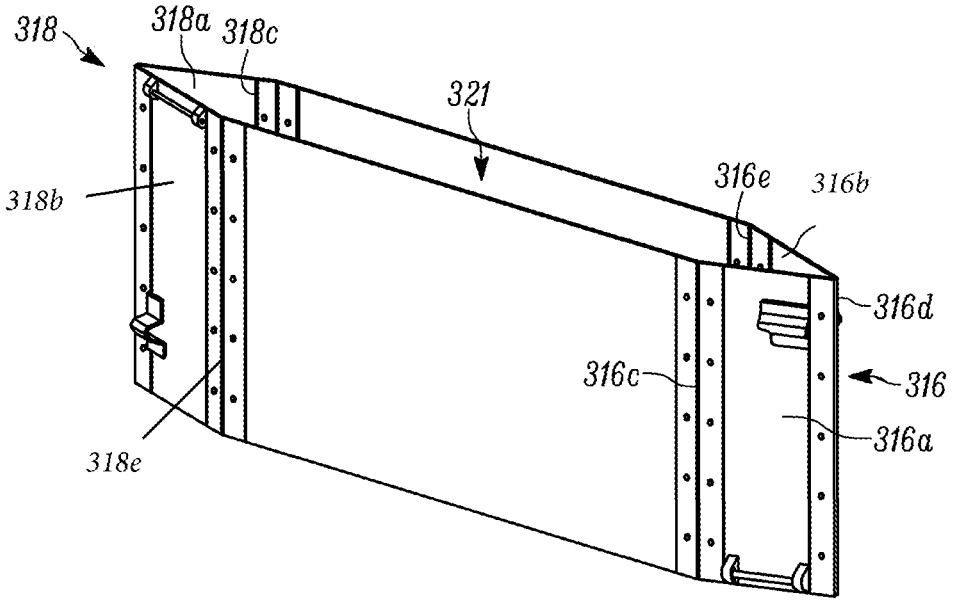
FIG. 10H illustrates a perspective view of the case of FIG. 10G in a collapsed orientation with portions removed.
Figure 11A:
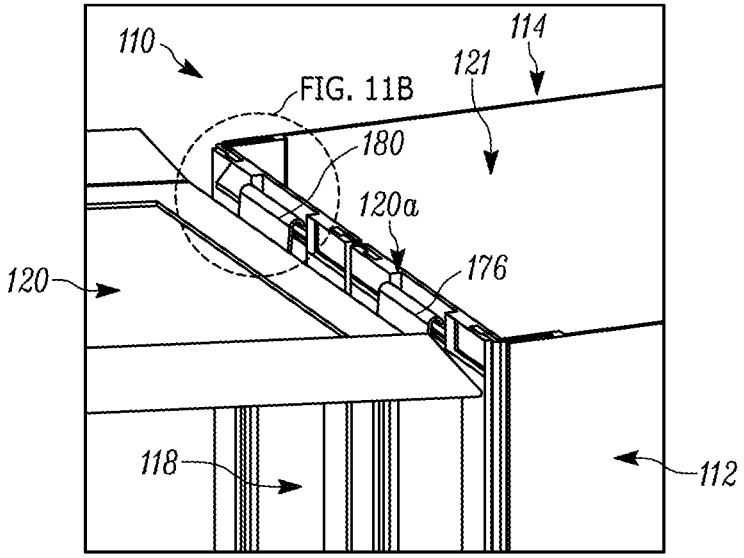
FIG. 11A is a perspective detail view of the case of FIG. 10A, illustrating a lid coupled to a side via a first watertight hinge.
Figure 11B:
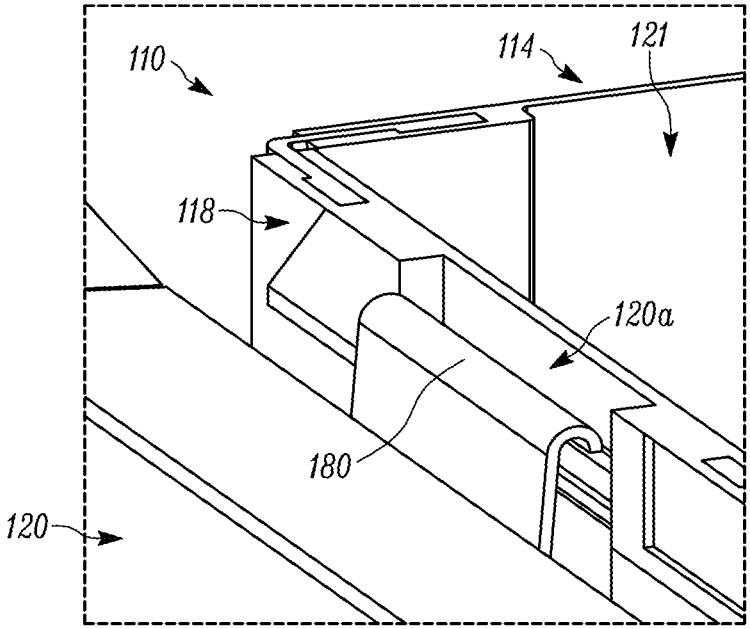
FIG. 11B is a perspective detail view of the lid of FIG. 11A, further illustrating the lid coupled to the side via the watertight hinge.
Figure 11C:
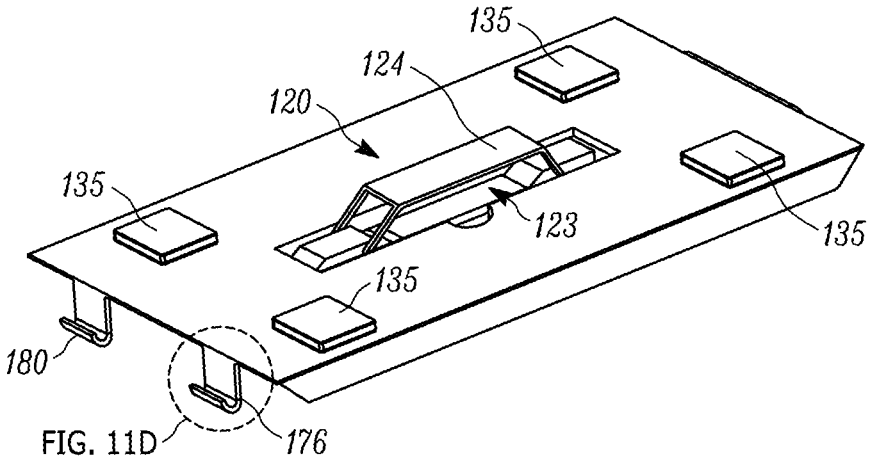
FIG. 11C is a perspective view of the lid of FIG. 11A.
Figure 11D:
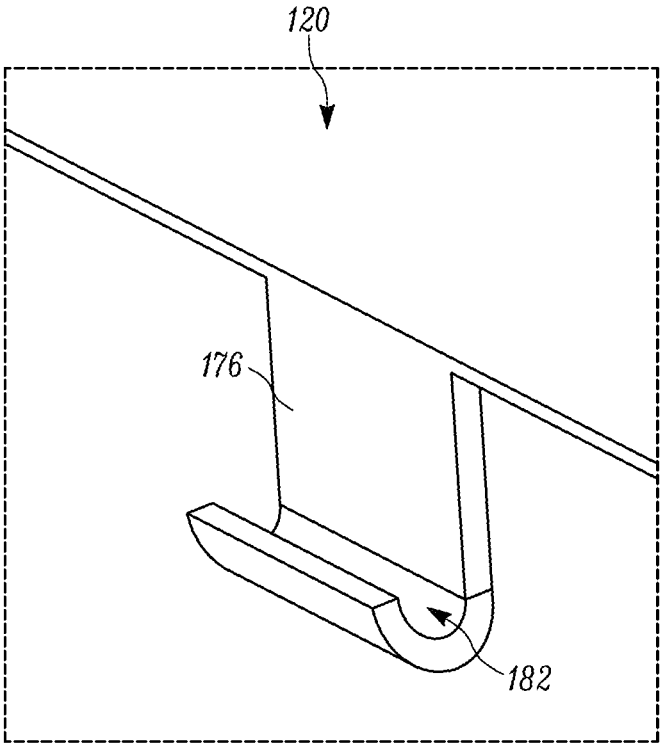
FIG. 11D is a perspective detail view of the lid of FIG. 11C, further illustrating the watertight hinge.

With reference to FIGS. 10G and 10H, in some embodiments a case 310 may include a bottom 322 formed as a single panel (as opposed to two panels 122*a*, 122*b* in FIG. 10C). The bottom 322 is substantially similar to the lid 320. A first end 316 of the case 310 folds outwardly as first and second panels 316*a* and 316*b* pivot about pin joints 316*c*, 316*d*, and 316*e*. Similarly, a second end 318 also folds outwardly relative to the expanded position as the third and fourth panels 318*a* and 318*b* pivot about pin joints 318*c*, 318*d*, and 318*e*. Meanwhile, the bottom 322 may be removed from the case 310 prior to folding, as with the lid 320. Folding the case 310 outwardly may further reduce the volume of the cavity 321 in the collapsed orientation as compared to the embodiment of FIGS. 10A-10D.

With reference again to FIG. 10A, and also to FIGS. 11A-11D, in some embodiments the lid 120 of the case 110 is removed from the case 110 prior to repositioning the case 110 into the collapsed orientation. A first coupling element or hook 176 and a second coupling element or hook 180 are coupled to the lid 120 and spaced apart from one another. In the illustrated embodiment, the hooks 176, 180 are fixed to the lid 120. The hooks 176, 180 have a substantially "J-shape" and extend away from an upper surface of the lid 120 so that a hook groove 182 of each hook 176, 180 is beyond a perimeter of the lid 120 (see e.g., FIGS. 11C and 11D). Each hook groove 182 is configured to removably couple with a respective feature (e.g., rod) on the second end 118, thereby forming a joint 120*a*. When the lid 120 is in the closed position, the hooks 176, 180 wrap around the respective rods so that the lid 120 may not easily be removed. When the lid 120 is pivoted to the open position, the hooks 176, 180 rest on top of the rods or other features and the lid 120 may be removed. The lid 120 can be easily removed from the case 110 without the use of additional tools.

Figure 14A:
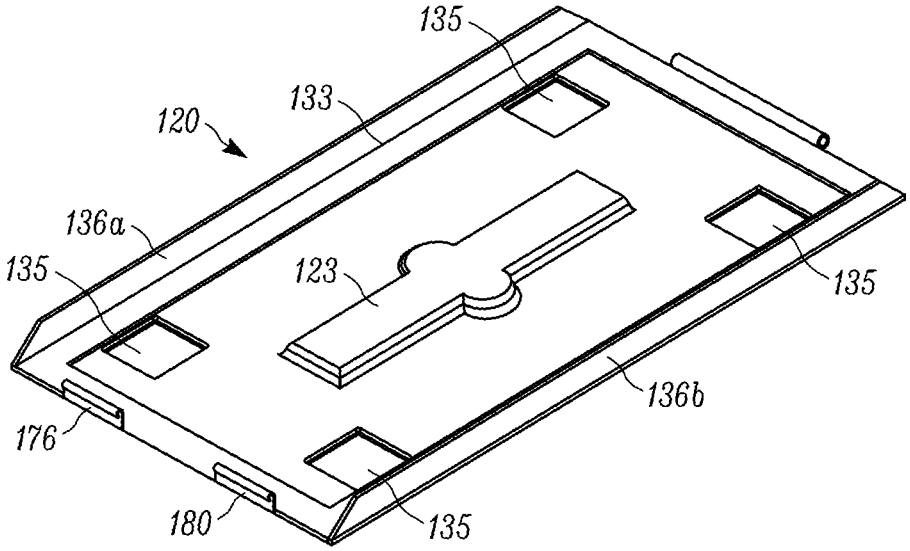
FIG. 14A illustrates an underside of the lid of the case shown in FIG. 10A with water-proof rubber in certain locations.
Figure 14B:
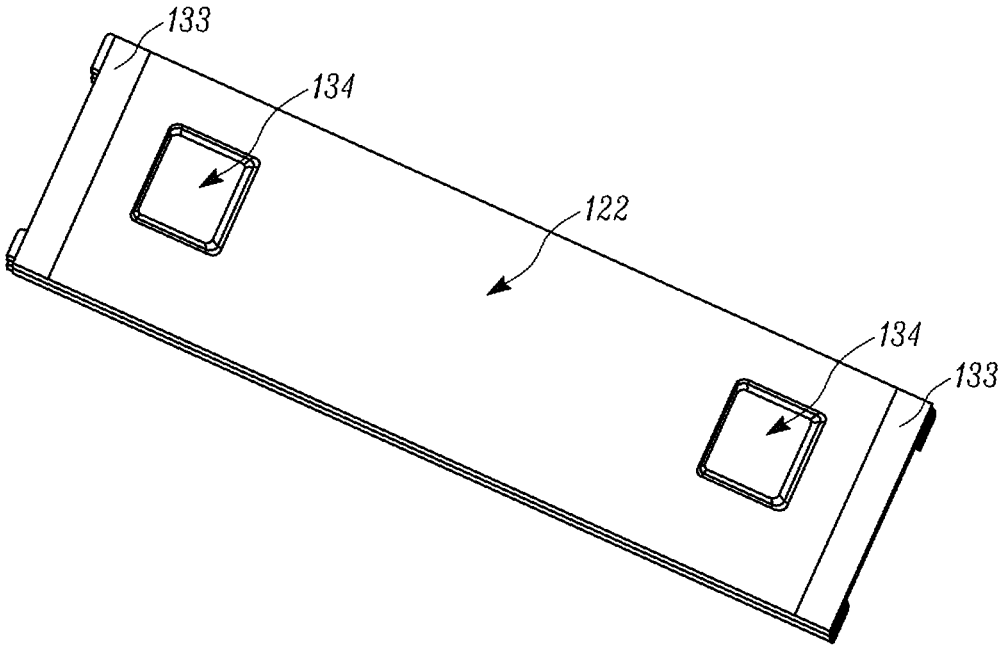
FIG. 14B illustrates an underside of the bottom of the case shown in FIG. 10A with water-proof rubber in certain locations.

With reference to FIGS. 14A and 14B, each of the lid 120 and the base 122 may further include a waterproof seal member or gasket 133 provided about the perimeter of an inner surface of the lid 120. The gasket 133 can be formed from any suitable waterproofing material (e.g., rubber) so as to prevent water from entering into the case while the lid 120 is in the closed position. The gasket is applied with an adhesive to the underside of the lid 120 and the bottom 122. The lid 120 further includes first and second flanges 136*a* and 136*b* that can overlap the first and second sides 112 and 114, respectively, when the lid 120 is in the closed position. The lid 120 may also include a recessed portion 123 that allows the handle 124 to be stowed while not in use. In the illustrated embodiment, the lid 120 is manufactured from stamped/folded aluminum and the handle 124 rivets onto the lid 124, although other embodiments include different materials and connections.

With reference to FIG. 10C, in some embodiments the first and second sides 112 and 114, the first and second ends 116 and 118, and the bottom 122 each include a first channel 152 and/or a second channel 154. Specifically, the first end 116 may include a first channel 152 proximate joint 116*c* and a second channel 154 proximate joint 116*e*. The second end 118 may include a first channel 152 proximate joint 118*c* and a second channel 154 proximate joint 118*e*. The first and second sides 112, 114 each include a first channel 152 proximate the respective joint 116*c*, 118*c*, and a second channel 154 proximate the respective joint 116*e*, 118*e*. Additionally, the first and second sides 112, 114 each include a third channel 160 proximate respective joint 122*c*, 122*e*. The first channel 152 of the bottom 122 is disposed proximate the joint 122*c* and the second channel 154 is disposed proximate the joint 122*e*. Other embodiments include various other numbers and arrangements of channels.

Figure 12A:
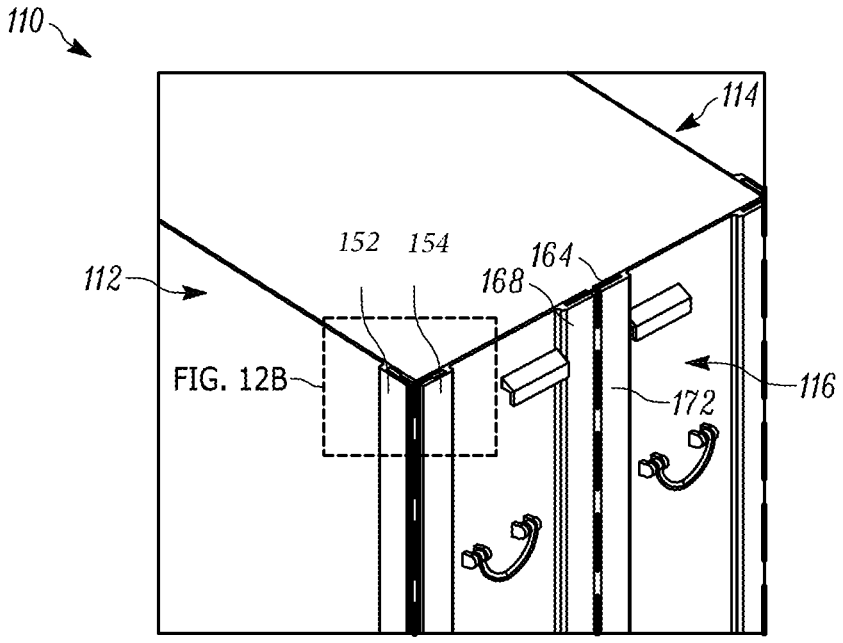
FIG. 12A illustrates a perspective detail view of rubber hinges on the case shown in FIG. 10*a*.
Figure 12B:
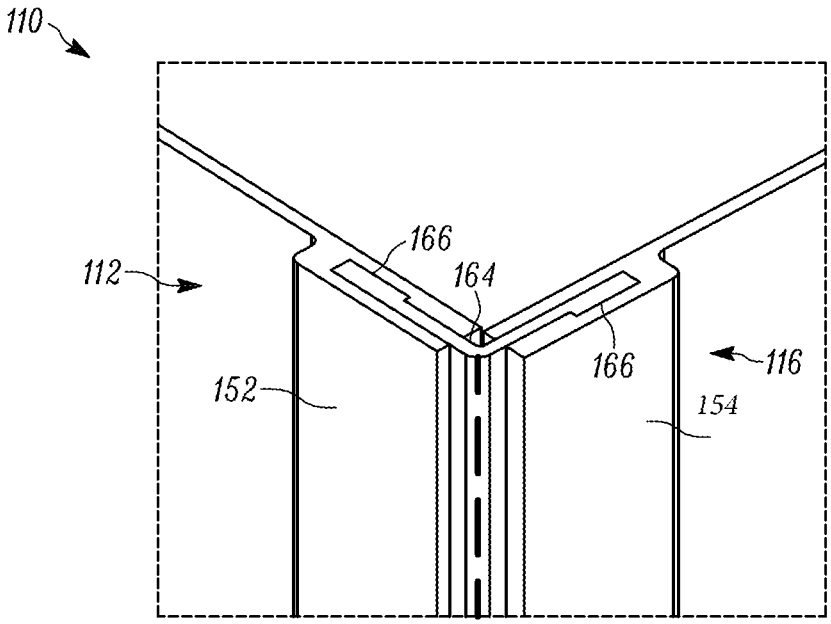
FIG. 12B is a perspective detail view of the rubber hinges of the case of FIG. 12A.

With reference to FIGS. 12A and 12B, in some embodiments each channel 152, 154, 160 includes an opening that receives a portion of a flexible hinge 164 (e.g., elastomeric gasket). Each hinge 164 extends across the respective joint 116*c* and 116*e*, 118*c* and 118*e*, and 122*c* and 122*e* (e.g., a hinge 164 may extend across joint 116*c* between a first channel 152 of the first side 112 and a second channel 154 of the first end 116). Each hinge 164 includes a flanged portion 166, which secures the hinge 164 in the respective channels 152, 156, 160, and may prevent the hinge 164 from being accidentally removed. The hinges 164 allow for rotation about each respective joint 116*c* and 116*e*, 118*c* and 118*e*, and 122*c* and 122*e*. In the illustrated embodiment, each hinge 164 is a single piece and is made from rubber or similarly flexible material. The rubber hinges 164 ensure durability during folding/unfolding of the hinges 164, and prevent liquids from entering the case through the hinges 164.

In some embodiments, and as described above, the first end 116 includes first and second panels 116*a* and 116*b* that are coupled together along a joint 116*d*. Similarly, the second end 118 incudes third and fourth panels 118*a* and 118*b* coupled together along a joint 118*d*. The bottom 122 includes fifth and sixth panels 122*a* and 122*b* coupled together along joint 122*d*. As shown in FIG. 12A, the first panel 116*a* may include a first central channel 168 disposed adjacent the joint 116*d*, and the second panel 116*b* may include a second central channel 172 disposed adjacent the joint 116*d*. The central channels 168, 172 are substantially the same as the channels 152, 154, 160. A hinge 164, similar to the hinge shown in FIG. 12B, is received within the first and second central channels 168, 172, and allows for rotation about the joint 116*d*. Although not shown, one or more of the other panels 118*a*, 118*b*, 122*a*, and 122*b* may also receive a hinge 164 in similar channels to allow for rotation about joints 118*d* and 122*d*, and for water-tight sealing.

Figure 13A:
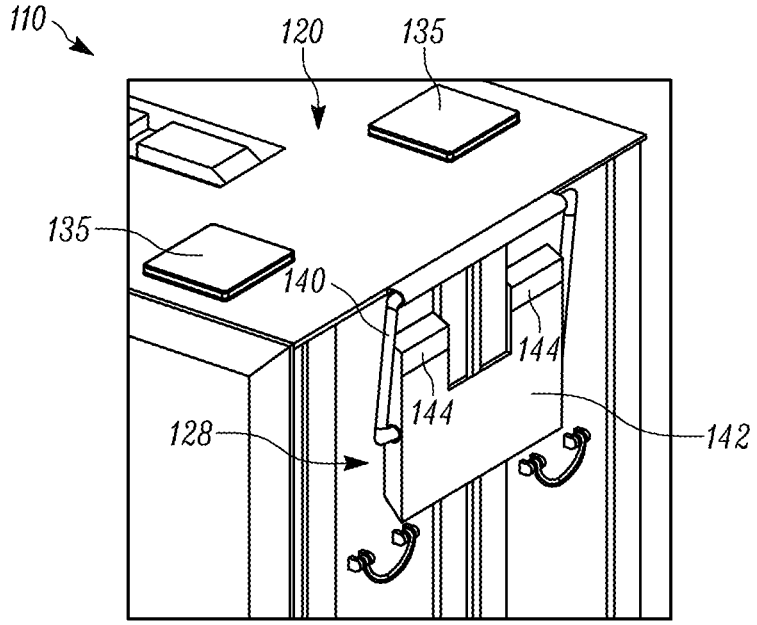
FIG. 13A is a perspective detail view of the case of FIG. 10A, illustrating a top latch in a latched orientation.
Figure 13B:
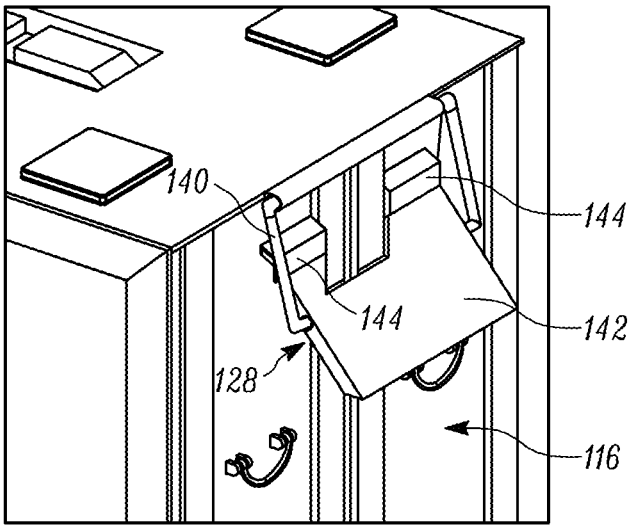
FIG. 13B is a perspective detail view of the case of FIG. 10A, illustrating the top latch in an unlatched orientation.

With reference to FIGS. 13A and 13B, the top latch 128 of case 110 is depicted in a latched orientation (FIG. 13A) and an unlatched orientation (FIG. 13B). The top latch 128 includes a first pivoting member 142 that engages a pair of first protrusions 144 (e.g., tabs) on the first face 116 to tension a first clip 140.

Figure 13C:
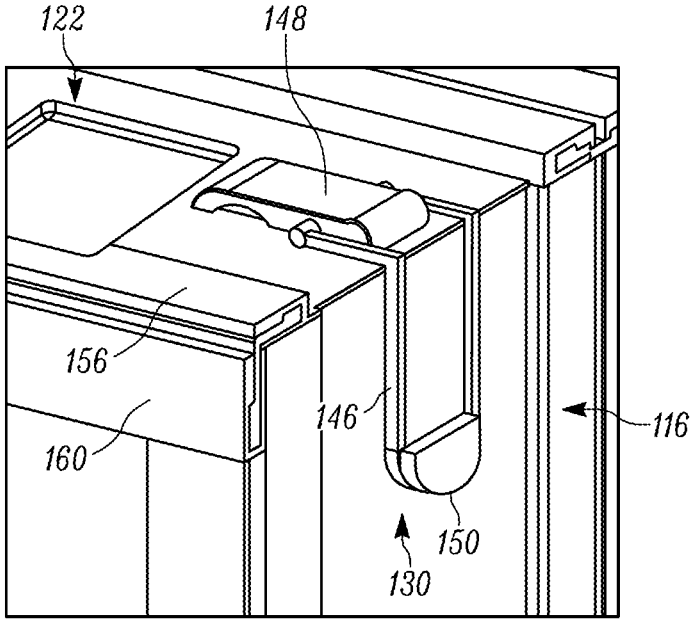
FIG. 13C is a perspective detail view of the case of FIG. 10A, illustrating a bottom latch in a latched orientation.
Figure 13D:
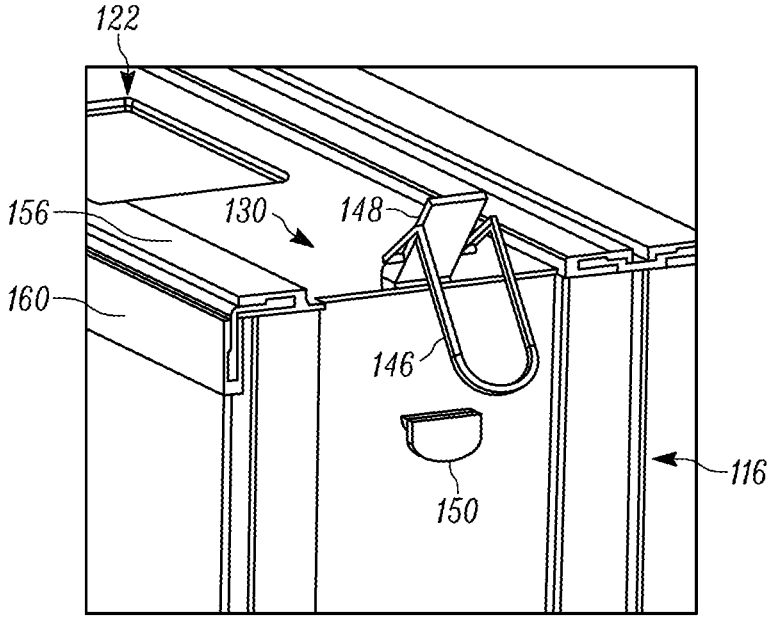
FIG. 13D is a perspective detail view of the case of FIG. 10A, illustrating the bottom latch in an unlatched orientation.

With reference to FIGS. 13C and 13D, the bottom latch 130 is depicted in a latched orientation (FIG. 13C) and an unlatched orientation (FIG. 13D). The bottom latch 130 includes a pivoting member 148 rotatably pinned to a surface of the bottom 122 and pivotable to tension a second clip 146. The second clip 146 engages a second protrusion 150 (e.g., tab) provided on the adjacent face of the first end 116. In this way, the bottom latch 130 secures the first end 116 to the bottom 122 in the expanded orientation. The second side 118 can also include bottom latches 130 to secure the second side 118 to the bottom 122 in the expanded orientation.

Figure 15A:
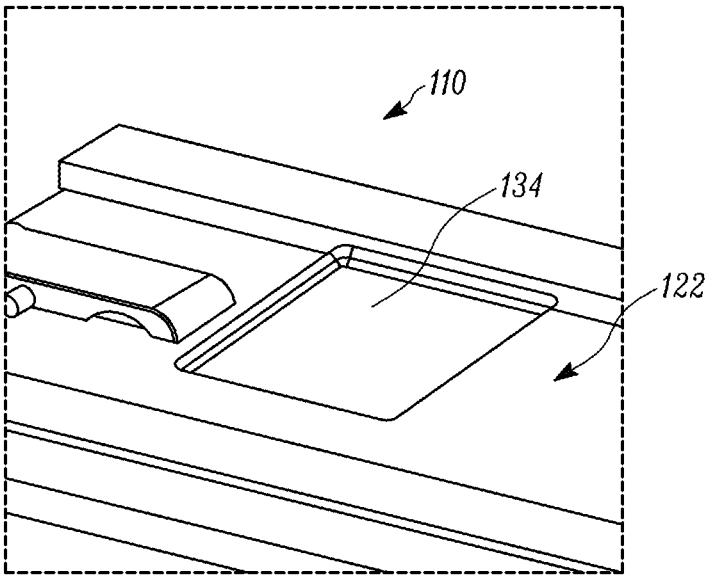
FIG. 15A is a perspective detail view of the case of FIG. 10A, illustrating a recessed portion of a bottom for stacking of cases.

As illustrated in FIG. 15A, the bottom 122 may include a recess 134. In the illustrated embodiment a recess 134 is disposed proximate each corner of the bottom 122. The recesses may be rectangular in shape, or any other suitable shape (e.g., circular). Other embodiments include different numbers and locations of recesses than that illustrated.

Figure 15B:
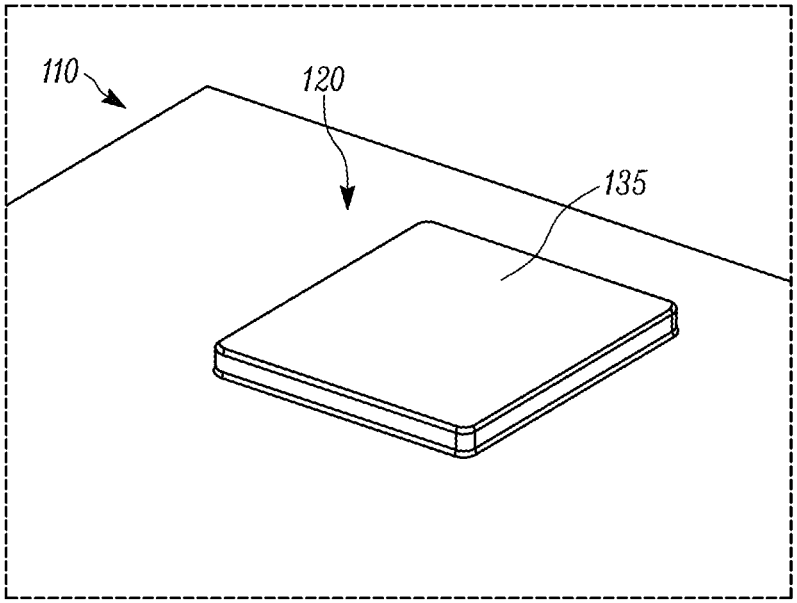
FIG. 15B illustrates a perspective detail view of the case of FIG. 10A, illustrating a protruding portion of the lid for stacking of cases.

As illustrated in FIG. 15B, the lid 120 may include projections 135. In the illustrated embodiment a projection 135 is disposed proximate each corner of the bottom 120, in a substantially similar location relative to the recesses 134 on the bottom 122. The projections 135 have a substantially complementary shape to the recesses (e.g., rectangular).

Figure 15C:
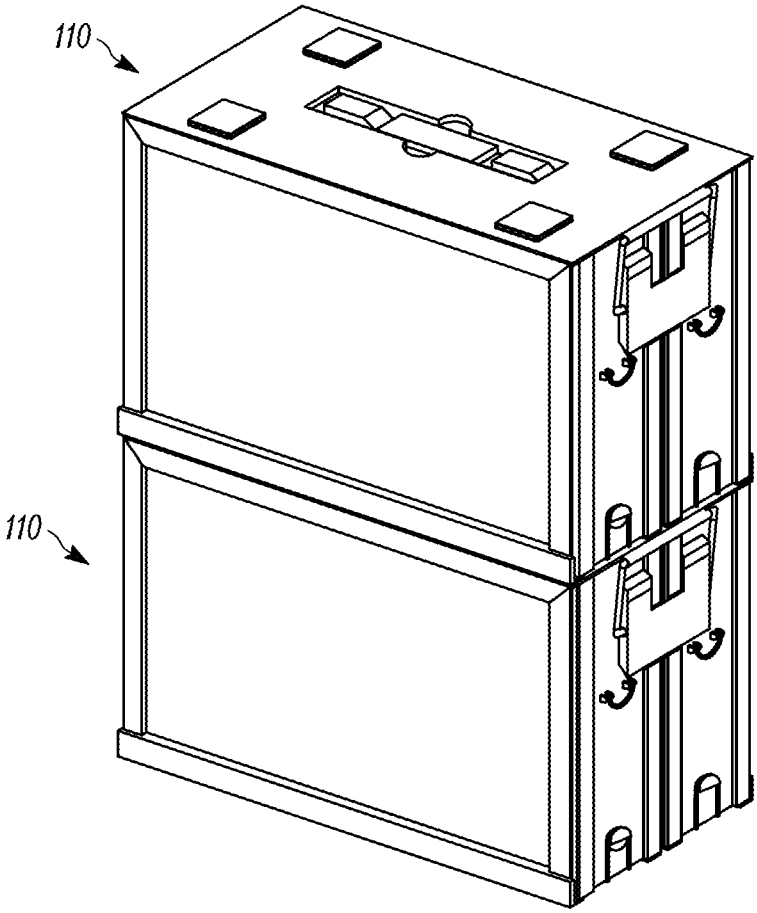
FIG. 15C is a perspective view of a first case of FIG. 10A stacked with a second case of FIG. 10*a*.
Figure 16:
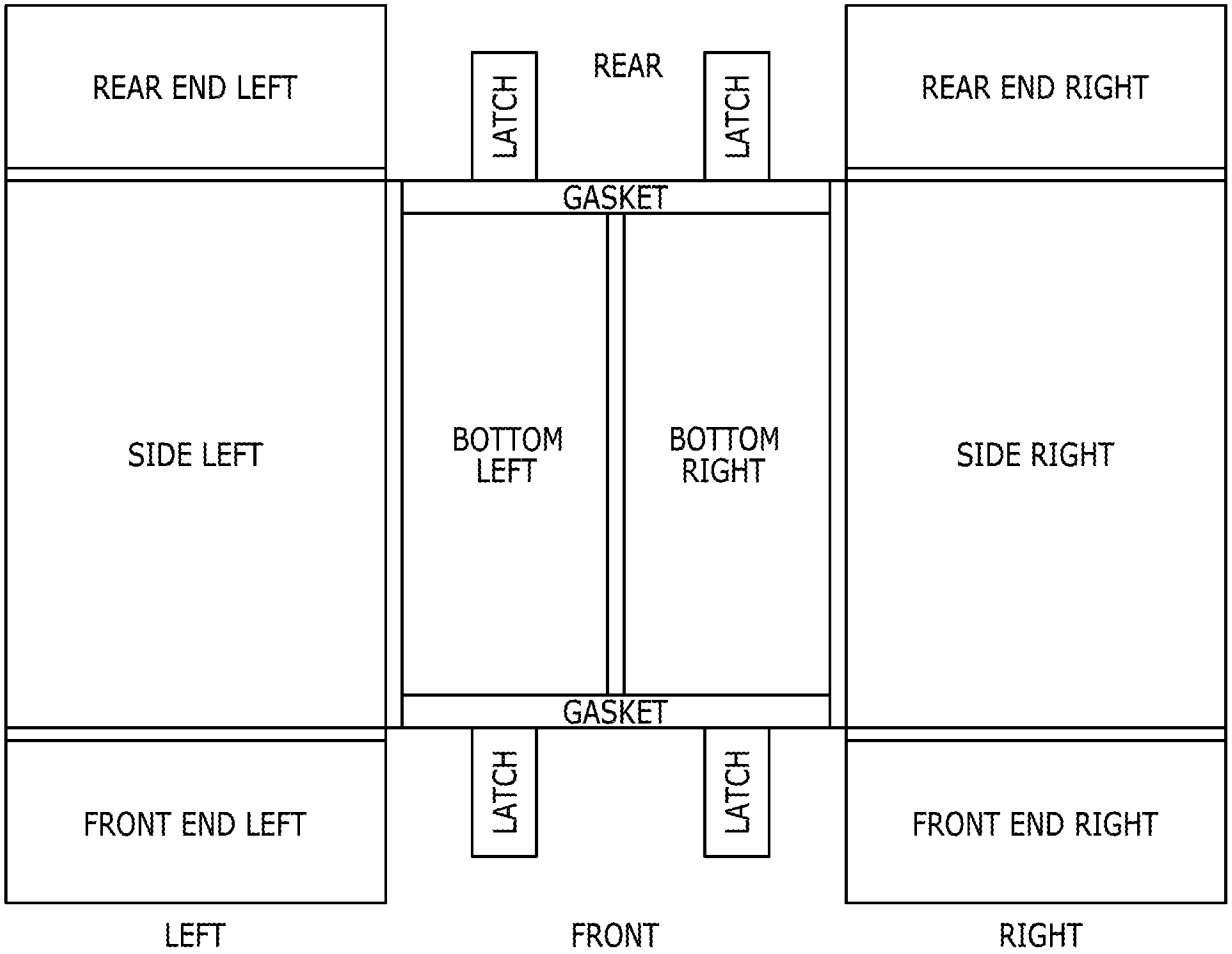
FIG. 16 illustrates an assembly layout of the case shown in FIG. 10A prior to final hinge installation.

With reference to FIG. 15C, a first case 110 may be stacked with a second case 110. The recesses 134 of one case 110 (i.e., the upper case) mate with the projections 135 of the other case 110 (i.e., the lower case). The projections 135 are received with a friction fit within the recesses 134, and the cases 110 are held together. Positioning the handle 124 in the recess 123 further facilitates stacking.

With reference to FIG. 17, a process of forming one of the cases described herein is illustrated. During initial production, the total number of walls or panels (not including the lid) may be eight. Together these panels form the main structure of the case.

Following panel cutting and finishing process, the panels may be returned to stock to await their next operation. The panel assembly may begin with the attachment of the latches to the finished bottom left and right panels. The latches may be attached at each end of the panel and secured and sealed with rivets. The end panels may be fitted with a bossed structure, which forms a part of the latch. These are secured and sealed with pressed rivets. These panels are again returned to stock until needed for the final assembly.

For the final stages of assembly, the bottom halves may be joined together with an extruded elastomer material that will form the hinge joint. This hinge material may be stretched to reduce its size and then the bottom panels grooves are slipped over the hinge. The elastomer is then relaxed and allowed to expand, and as it does, it conforms to the grooves in the panel to secure it in place. The panel will rest for a fixed period to allow the elastomer hinge to fully conform. The hinge this then trimmed to length. This process is repeated and applied to the remaining panels.

A conformal gasket may then be applied to the ends of the bottom panels at the front and rear with adhesive. This provides a seal to the lower half of the case. After curing, the final step is to fold the layout into box form and apply the elastomer hinge to the end panels at the center. The case is then secured into position by clasping the bottom latches to the end panels. The assembly is completed with the installation of the removable cover to the top of the case.

Although the invention has been described in detail with reference to certain preferred embodiments, variations and modifications exist within the scope and spirit of one or more independent aspects of the invention as described.

What is claimed is:

1. A foldable, waterproof case comprising:

a first wall;

a second wall coupled to the first wall and at least partially defining a cavity within the case;

a lid coupled to the second wall and configured to selectively cover the cavity; and a hinge disposed between the first wall and the second wall, the first wall rotatable relative to the second wall between a first, expanded position of the case and a second, collapsed position of the case, wherein in the first position the cavity includes a first volume and in the second position, the cavity includes a second volume less than the first volume, the hinge providing a waterproof connection between the first and second walls in the first position and in the second position, wherein the first wall includes a first panel, a second panel, and a hinge disposed between the first and second panels, the first panel rotatable relative to the second panel between the first position and the second position of the case, and wherein the first panel and the second panel fold outwardly, away from the cavity in the second position of the case.

2. The case of claim 1, wherein the first wall and the second wall are each made from metal.

3. The case of claim 1, wherein the lid includes one of a barrel and a pin, and the second wall includes the other of the barrel and the pin, the pin removably received within the barrel to couple the lid to the second wall, wherein the pin is pivotable within the barrel.

4. A foldable, waterproof case comprising:

a first wall;

a second wall coupled to the first wall and at least partially defining a cavity within the case;

a lid coupled to the second wall and configured to selectively cover the cavity; and a hinge disposed between the first wall and the second wall, the first wall rotatable relative to the second wall between a first, expanded position of the case and a second, collapsed position of the case, wherein in the first position the cavity includes a first volume and in the second position, the cavity includes a second volume less than the first volume, the hinge providing a waterproof connection between the first and second walls in the first position and in the second position, wherein the first wall includes a first channel and the second wall includes a second channel, and wherein the hinge is a flexible membrane and is received within the first channel and the second channel.

5. The case of claim 4, wherein the first wall and the second wall are each made from metal.

6. The case of claim 4, wherein the lid includes one of a barrel and a pin, and the second wall includes the other of the barrel and the pin, the pin removably received within the barrel to couple the lid to the second wall, wherein the pin is pivotable within the barrel.

7. A foldable, waterproof case comprising:

a first wall;

a second wall coupled to the first wall and at least partially defining a cavity within the case;

a lid coupled to the second wall and configured to selectively cover the cavity;

a hinge disposed between the first wall and the second wall, the first wall rotatable relative to the second wall between a first, expanded position of the case and a second, collapsed position of the case, wherein in the first position the cavity includes a first volume and in the second position, the cavity includes a second volume less than the first volume, the hinge providing a waterproof connection between the first and second walls in the first position and in the second position; and a base coupled to the first wall and the second wall and disposed opposite the lid, the base including one of a recess and a projection and the lid including the other of the recess and the projection, the recess and the projection having a complementary shape, wherein the recess configured to receive a projection on a second lid having substantially the same shape as the projection on the lid.

8. The case of claim 7, wherein the lid includes one of a barrel and a pin, and the second wall includes the other of the barrel and the pin, the pin removably received within the barrel to couple the lid to the second wall, wherein the pin is pivotable within the barrel.

9. A foldable, waterproof case comprising:

a first wall;

a second wall coupled to the first wall and at least partially defining a cavity within the case;

a lid coupled to the second wall and configured to selectively cover the cavity; and a hinge disposed between the first wall and the second wall, the first wall rotatable relative to the second wall between a first, expanded position of the case and a second, collapsed position of the case, wherein in the first position the cavity includes a first volume and in the second position, the cavity includes a second volume less than the first volume, the hinge providing a waterproof connection between the first and second walls in the first position and in the second position, wherein the first wall is a first side of the case and the second wall is a first end, the case further comprising, a third wall opposite the first wall and coupled to the second wall;

a fourth wall opposite the second wall and coupled to the first wall and the third wall;

a base coupled to the first, second, third, and fourth walls;

wherein the first, second, third, and fourth walls, and the base are moveable relative to one another between the first position and the second position, and wherein water is prevented from entering or exiting the cavity when the lid is coupled to the first end in the first position.

10. A foldable, waterproof case comprising:

a first wall;

a second wall coupled to the first wall and at least partially defining a cavity within the case;

a lid coupled to the second wall and configured to selectively cover the cavity;

a hinge disposed between the first wall and the second wall, the first wall rotatable relative to the second wall between a first, expanded position of the case and a second, collapsed position of the case, wherein in the first position the cavity includes a first volume and in the second position, the cavity includes a second volume less than the first volume, the hinge providing a waterproof connection between the first and second walls in the first position and in the second position; and a base positioned opposite the lid and including one of a pivoting member and a projection, and the second wall including the other of the pivoting member and the projection, wherein the pivoting member is moveable between a locked position and a release position, the pivoting member engaging the projection in the locked position and creating a waterproof seal between the base and the second wall, and the pivoting member disengaging the projection in the unlocked position and allowing the base to move relative to the second wall.

11. A foldable, waterproof case comprising:

a first wall;

a second wall coupled to the first wall and at least partially defining a cavity within the case;

a lid coupled to the second wall and configured to selectively cover the cavity;

a hinge disposed between the first wall and the second wall, the first wall rotatable relative to the second wall between a first, expanded position of the case and a second, collapsed position of the case, wherein in the first position the cavity includes a first volume and in the second position, the cavity includes a second volume less than the first volume, the hinge providing a waterproof connection between the first and second walls in the first position and in the second position; and a base coupled to the first wall and the second wall and disposed opposite the lid, wherein a latch is configured to mechanically secure the lid relative to the second wall.

12. The case of claim 11, wherein the base includes a first base panel, a second base panel, and a hinge disposed between the first and second base panels, the first base panel rotatable relative to the second base panel between the first position and the second position of the case.

13. The case of claim 11, wherein the base is formed as a single piece and is removable from the second wall in the first position to enable the first and second walls to move to the second position.

14. A foldable case comprising:

a water-impermeable base;

a first, water-impermeable side coupled to the base about a first hinge;

a second, water-impermeable side coupled to the base about a second hinge, the second side positioned opposite the first side;

a first, water-impermeable end coupled to the base, and coupled between the first side about a third hinge and the second side about a fourth hinge;

a second, water-impermeable end coupled to the base, and coupled between the first side about a fifth hinge and the second side about a sixth hinge, the second end positioned opposite the first end;

a water-impermeable lid coupled to the first end and positioned opposite the base and selectively enclosing a cavity defined by the base, the first and second sides, and the first and second ends;

wherein the first and second sides, the first and second ends, and the base are moveable between a first expanded position of the case, and a second collapsed position of the case, wherein the case further includes at least one latch configured to mechanically secure the lid to the first end.

15. The foldable case of claim 14, wherein the first end includes a first panel, a second panel, and a seventh hinge disposed between the first and second panels, the first panel aligned with the second panel in the first expanded position, and oblique relative to the second panel in the second collapsed position.

16. The foldable case of claim 14, wherein the first panel and the second panel fold outwardly, away from the cavity in the second collapsed position.

17. The foldable case of claim 14, wherein the latch includes one of a pivoting member and a projection on the lid, and the latch includes the other of the pivoting member and the projection on the first end, wherein the pivoting member is moveable between a locked position and a release position, the pivoting member engaging the projection in the locked position and creating a waterproof seal between the lid and the first end, and the pivoting member disengaging the projection in the unlocked position and allowing the lid to move relative to the first end.

18. The foldable case of claim 14, wherein the lid includes a flange and a seal member disposed adjacent the flange, the flange configured to overlap with the first side and create a waterproof seal.

19. The foldable case of claim 14, wherein the first side includes a first channel and the first end includes a second channel, and wherein the hinge is a flexible membrane and is received within the first channel and the second channel.

20. The foldable case of claim 14, wherein the base is removable from the first and second walls and the first and second ends in the first expanded position to enable the first and second walls and the first and second ends to move to the second collapsed position.

* * * * *